US005411614A

United States Patent [19]

Ogawa et al.

[11] Patent Number: 5,411,614

[45] Date of Patent: May 2, 1995

[54] METHOD OF MAKING TI-AL-V-MO ALLOYS

[75] Inventors: Atsushi Ogawa; Kuninori Minakawa; Kazuhide Takahashi, all of Kawasaki, Japan

[73] Assignee: NKK Corporation, Tokyo, Japan

[21] Appl. No.: 292,617

[22] Filed: Aug. 18, 1994

Related U.S. Application Data

[60] Division of Ser. No. 170,672, Dec. 20, 1993, Pat. No. 5,362,441, which is a continuation of Ser. No. 95,724, Jul. 21, 1993, abandoned, which is a division of Ser. No. 880,743, May 8, 1992, Pat. No. 5,256,369, which is a continuation of Ser. No. 719,663, Jun. 24, 1991, Pat. No. 5,124,121, which is a continuation of Ser. No. 547,924, Jul. 3, 1990, abandoned.

[30] Foreign Application Priority Data

Jul. 10, 1989 [JP] Japan ..... 1-177759
Feb. 26, 1990 [JP] Japan ..... 2-044993

[51] Int. Cl.[6] ..... C22C 14/00

[52] U.S. Cl. ..... 148/670; 420/420; 148/421; 148/671

[58] Field of Search ..... 148/670, 671, 421; 420/420

[56] References Cited

U.S. PATENT DOCUMENTS

| | | | |
|---|---|---|---|
| 3,867,208 | 2/1975 | Grekov et al. | 148/670 |
| 4,067,734 | 1/1978 | Curtis et al. | 148/421 |
| 4,098,623 | 7/1978 | Ibaraki et al. | 148/669 |
| 4,299,626 | 11/1981 | Paton et al. | 420/420 |
| 4,842,653 | 6/1989 | Wirth et al. | 148/671 |
| 4,867,807 | 9/1989 | Torisawa et al. | 148/670 |
| 4,871,400 | 10/1989 | Shindo et al. | 420/417 |
| 4,944,914 | 7/1990 | Ogawa et al. | 148/12.7 B |
| 5,160,554 | 11/1992 | Bania et al. | 148/670 |
| 5,215,600 | 6/1993 | Bertolini et al. | 420/902 |
| 5,217,548 | 6/1993 | Kuboki et al. | 420/902 |

OTHER PUBLICATIONS

Wert et al, "Enhanced Superplasticity and Strength in Modified Ti-6A1-4V Alloys", Metallurgical Transactions, vol. 14A, Dec. 1983, p. 2535.

Ghosh et al, "Influences of Material Parameters and Microstructure on Superplastic Forming", Metalurgical Transactions 13A, May 1982, p. 733.

Leader et al, "The Effect of Alloying Additions on the Superplastic Properties of Ti-6 Pct A1-4 Pct V, Metallurgical Transactions", vol. 17A, Jan. 1986, p. 93.

A. I. Khorev, "Complex Alloying of Titanium Alloys, Metallovedenie i Termicheskaya Obrabotka Mctallov", No. 8, pp. 58-63, Aug., 1975. (English translation).

*Primary Examiner*—Upendra Roy

*Attorney, Agent, or Firm*—Frishauf, Holtz, Goodman & Woodward

[57] ABSTRACT

A method of making a titanium base alloy comprising the steps of heating a titanium base alloy to a temperature ranging from $\beta$-transus minus 250° C. to $\beta$-transus; and hot working the heated alloy with a reduction ratio of at least 50%. The titanium base alloy consists essentially of about 3.42 to 5 wt. % Al, 2.1 to 3.7 wt. % V, 0.85 to 2.37 wt. % Mo, at least 0.01 wt. % O, at least one element selected from the group consisting of Fe, Co, Cr, and the balance being titanium. The invention also includes superplastic forming of said alloys. The titanium alloy satisfies the following equations:

$$0.85 \text{ wt. } \% \leqq X \text{ wt. } \% \leqq 3.15 \text{ wt. } \%,$$

$$7 \text{ wt. } \% \leqq Y \text{ wt. } \% \leqq 13 \text{ wt. } \%,$$

$$X \text{ wt. } \% = Fe \text{ wt. } \% + Co \text{ wt. } \% + 0.9\ Cr \text{ wt. } \%$$

$$Y \text{ wt. } \% = 2 \times Fe \text{ wt. } \% + 2 \times Co \text{ wt. } \% + 1.8 \times Cr \text{ wt. } \% + 1.5 \times V \text{ wt. } \% + Mo \text{ wt. } \%.$$

54 Claims, 5 Drawing Sheets

METHOD OF MAKING TI-AL-V-MO ALLOYS

This is a division of application Ser. No. 08/170,672 filed Dec. 20, 1993, now U.S. Pat. No. 5,362,441, which is a continuation of application Ser. No. 08/095,724, filed Jul. 21, 1993, (abandoned), which is a division of application Ser. No. 07/880,743, filed May 8, 1992, now U.S. Pat. No. 5,256,369, issued Oct. 26, 1993, which is a continuation of application Ser. No. 07/719,663, filed Jun. 24, 1991, now U.S. Pat. No. 5,124,121, issued Jun. 23, 1992, which is a continuation of application Ser. No. 07/547,924, filed Jul. 3, 1990, (abandoned).

BACKGROUND OF THE INVENTION

1. Field of the Invention

The invention relates to the field of metallurgy and particularly to the field of titanium base alloys having excellent formability and method of making thereof and method of superplastic forming thereof.

2. Description of the Related Art

Titanium alloys are widely used as aerospace materials, e.g., in airplanes and rockets since the alloys possess tough mecanical properties and are comparatively light.

However the titanium alloys are difficult material to work. When finished products have a complicated shape, the yield in terms of weight of the product relative to that of the original material is low, which causes a significant increase in the production cost.

In case of the most widely used titanium alloy, which is Ti—6Al—4V alloy, when the forming temperature becomes below 800° C., the resistance of deformation increases significantly, which leads to the generation of defects such as cracks.

To avoid the disadvantage of high production cost, a new technology called superplastic forming which utilizes superplastic phenomena, has been proposed.

Superplasticity is the phenomena in which materials under certain conditions, are elongated up to from several hundred to one thousand percent, in some case, over one thousand percent, without necking down.

One of the titanium alloys wherein the superplastic forming is performed is Ti—6Al—4V having the microstructure with the grain size of 5 to 10 micron meter.

However, even in case of the Ti—6Al—4V alloy, the temperature for superplastic forming ranges from 875° to 950° C., which shortens the life of working tools or necessitates costly tools. U.S. Pat. No. 4,299,626 discloses titanium alloys in which Fe, Ni, and Co are added to Ti—6Al—4V to improve superplastic properties having large superplastic elongation and small deformation resistance.

However even with the alloy described in U.S. Pat. No. 4,299,626, which is Ti—6Al—4V—Fe—Ni—Co alloy developed to lower the temperature of the superplastic deformation of Ti—6Al—4V alloy, the temperature can be lowered by only 50° to 80° C. compared with that for Ti—6Al—4V alloy, and the elongation obtained at such a temperature range is not sufficient.

Moreover, this alloy contains 6 wt. % Al as in Ti—6Al—4V alloy, which causes the hot workability in rolling, or forging, being deteriorated.

SUMMARY OF THE INVENTION

It is an object of the invention to provide a titanium alloy having improved superplastic properties.

It is an object of the invention to provide a high strength titanium alloy with improved superplastic properties compared with aforementioned Ti—6Al—4V alloy and Ti—6Al—4V—Fe—Ni—Co alloy, having large superplastic elongation and small resistance of deformation in superplastic deformation and excellent hot workability in the production process, and good cold workability.

It is an object of the invention to provide a method of making the above-mentioned titanium alloy.

It is an object of the invention to provide a method of superplastic forming of the above-mentioned titanium alloy.

(a) According to the invention a titanium alloy is provided with approximately 4 wt. % Al and 2.5 wt. % V with below 0.15 wt. % O as contributing element to the enhancement of the mechanical properties, and 0.85~3.15 wt. % Mo, and at least one element from the group of Fe, Ni, Co, and Cr, as beta stabilizer and contributing element to the lowering of beta transus, with a limitation of the following, 0.85 wt. %≦Fe wt. %+Ni wt. %+Co wt. %+0.9×Cr wt. %≦3.15 wt. %, 7 wt. %≦2×Fe wt. %+2×Ni wt. %+2×Co wt. %+1.8×Cr wt. %+15×V+Mo wt. %≦13 wt. %.

(b) According to the invention a titanium alloy is provided with approximately 4 wt. % Al and 2.5 wt. % V, with below 0.15 wt. % O as contributing element to the enhancement of the mechanical properties, and 0.85~3.15 wt. % Mo, and at least one element from the group of Fe, Ni, Co, and Cr, as beta stabilizer and contributing element to the lowering of beta transus, with a limitation of the following, 0.85 wt. %≦Fe wt. %+Ni wt. %+Co wt. %+0.9×Cr wt. %≦3.15 wt. %, 7 wt. %≦2×Fe wt. %+2×Ni wt. %+2×Co wt. %+1.8×Cr wt. %+1.5×V+Mo wt. %≦13 wt. %, and having alpha crystals with the grain size of at most 5 micron meter.

(c) According to the invention a method of making titanium base alloy is provided comprising the steps of;

reheating the titanium base alloy specified below to a temperature in the temperature range of from $\beta$ transus minus 250° C. to $\beta$ transus;

a titanium base alloy with approximately 4 wt. % Al and 2.5 wt. % V with below 0.15 wt. % O as contributing element to the enhancement of the mechanical properties, and 0.85~3.15 wt. % Mo, and at least one element from the group of Fe, Ni, Co, and Cr, as beta stabilizer and contributing element to the lowering of beta transus, with a limitation of the following, 0.85 wt. %≦Fe wt. %+Ni wt. %+Co wt. %+0.9×Cr≦3.15 wt. %, 7 wt. %≦2×Fe wt. %+2×Ni wt. %+2×Co wt. %+1.8×Cr wt. %+1.5×V+Mo wt. %≦13 wt. %.

hot working the heated alloy with the reduction ratio of at least 50%.

(d) According to the invention a superplastic forming of a titanium base alloy is provided comprising the steps of;

heat treating the the titanium base alloy specified below to a temperature in the temperature range of from $\beta$ transus minus 250° C. to $\beta$ transus;

a titanium base alloy with approximately 4 wt. % Al and 2.5 wt. % V, with below 0.15 wt. % O as contributing element to the enhancement of the mechanical properties, and 0.85~3.15 wt. % Mo, and at least one element from the group of Fe, Ni, Co, and Cr, as beta stabilizer and contributing element to the lowering of beta transus, with a limitation of the following, 0.85 wt. %≦2×Fe wt. %+Ni wt. %+Co wt. %+0.9×Cr wt. %≦3.15 wt. %, 7 wt. %≦2×Fe wt. %+2×Ni wt. %+2×Co wt. %+1.8×Cr wt. %+1.5×V+Mo wt. %≦13 wt. %.

superplastic forming the above heat treated alloy.

These and other objects and features of the present invention will be apparent from the following detailed description.

The abscissa denotes 2×Fe wt. %+2×Ni wt. %+2×Co wt. %+1.8×Cr wt. % 1.5×V wt. %+Mo wt. %, and the ordinate denotes the maximum superplastic elongation.

Figure 3:
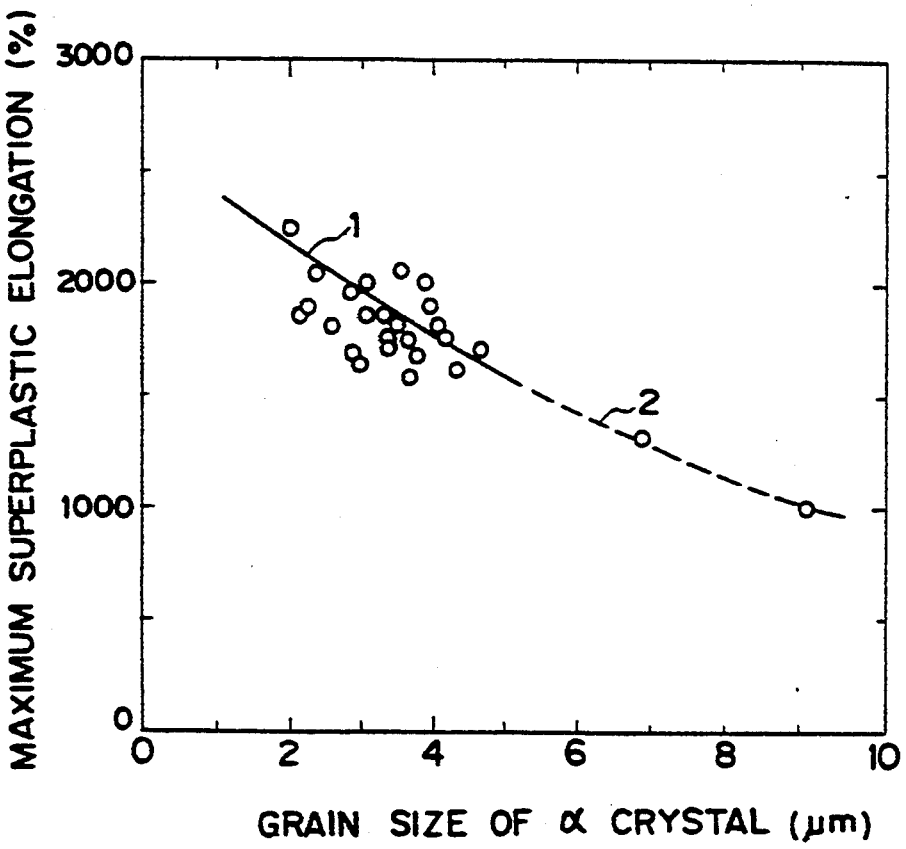

FIG. 3 shows the change of the maximum superplastic elongation of the titanium alloys, having the same chemical composition with those of the invented alloys, with respect to the change of the grain size of α-crystal thereof. The abscissa denotes the grain size of α-crystal of the titanium alloys, and the ordinate denotes the maximum superplastic elongation.

Figure 4:
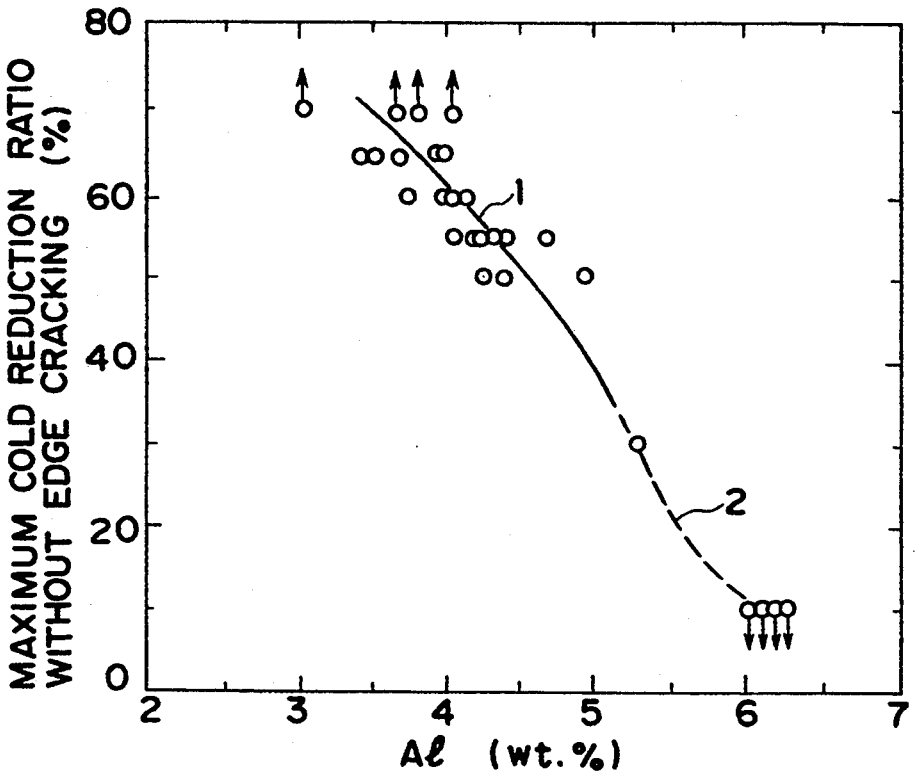

FIG. 4 shows the influence of Al content on the maximum cold reduction ratio without edge cracking. The abscissa denotes Al wt. %, and the ordinate denotes the maximum cold reduction ratio without edge cracking.

Figure 5:
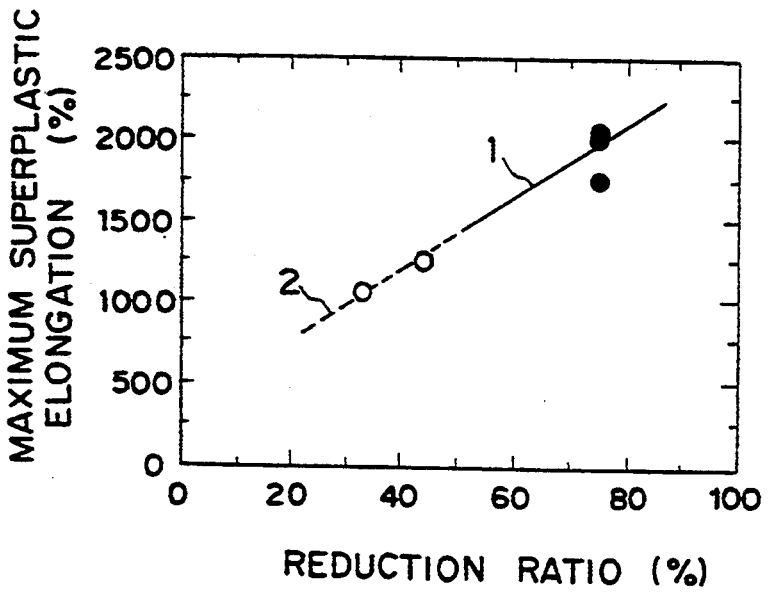

FIG. 5 shows the relationship between the hot reduction ratio and the maximum superplastic elongation.

The abscissa denotes the reduction ratio and the ordinate denotes the maximum superplastic elongation.

The bold curves denote those within the scope of the invention. The dotted curves denote those without the scope of the invention.

DESCRIPTION OF THE PREFERRED EMBODIMENT

The inventors find the following knowledge concerning the required properties.

(1) By adding a prescribed quantity of Al, the strength of titanium alloys can be enhanced.

(2) By adding at least one element selected from the group of Fe, Ni, Co, and Cr to the alloy, and prescribe the value of Fe wt. %+Ni wt. %+Co wt. %+0.9×Cr wt. % in the alloy, the superplastic properties can be improved; the increase of the superplastic elongation and the decrease of the deformation resistance, and the strength thereof can be enhanced.

(3) By adding the prescribed quantity of Mo, the superplastic properties can be improved; the increase of the superplastic elongation and the lowering of the temperature wherein the superplasticity is realized, and the strength thereof can be enhanced.

(4) By adding the prescribed quantity of V, the strength of the alloy can be enhanced.

(5) By adding the prescribed quantity of O, the strength of the alloy can be enhanced.

(6) By prescribing the value of a parameter of beta stabilizer, 2×Fe wt. %+2×Ni wt. %+2×Co wt. %+1.8×Cr wt. %+1.5×V wt. %+Me wt. %, a sufficient superplastic elongation can be imparted to the alloy and the room temperature strength thereof can be enhanced.

(7) By prescribing the grain size of the α-crystal, the superplastic properties can be improved.

(8) By prescribing the temperature and the reduction ratio in making the alloy, the superplastic properties can be improved.

(9) By prescribing the reheating temperature in heat treating of the alloy prior to the superplastic deformation thereof, the superplastic properties can be improved.

This invention is based on the above knowledge and briefly explained as follows.

The invention is:

(1) A titanium base alloy consisting essentially of about 3.0 to 5.0 wt. % Al 2.1 to 3.7 wt. % V, 0.85 to 3.15 wt. % Mo, 0.01 to 0.15 wt. % O, at least one element from the group of Fe, Ni, Co, and Cr, and balance titanium, satisfying the following equations;

0.85 wt. %≦Fe wt. %+Ni wt. %+Co wt. %+0.9×Cr wt. % ≦3.15 wt. %, 7 wt. %≦X wt. %≦13 wt. %,

X wt. %=2×Fe wt. %+2×Ni wt. %+2×Co wt. %+1.8×Cr wt. %+1.5×V+Mo wt. %.

(2) A titanium base alloy for superplastic forming consisting essentially of about 3.0 to 5.0 wt. % Al, 2.1 to 3.7 wt. % V, 0.85 to 3.15 wt. % Mo, 0.01 to 0.15 wt. % O, at least one element from the group of Fe, Ni, Co, and Cr, and balance titanium, satisfying the following equations;

0.85 wt. %≦Fe wt. %+Ni wt. %+Co wt. %+0.9×Cr wt. % ≦3.15 wt. %, 7 wt. %≦X wt. %≦13 wt. %,

X wt. %=2×Fe wt. %+2×Ni wt. % 2×Co wt. %+1.8×Cr wt. %+1.5×V+Me wt. %;

and having primary alpha crystals with the grain size of at most 5 micron meter.

(3) A method of making a titanium base alloy for superplastic forming comprising the steps of:

reheating the titanium base alloy specified below to a temperature in the temperature range of from β transus minus 250° C. to β transus;

a titanium base alloy for superplastic forming consisting essentially of about 3.0 to 5.0 wt. % Al, 2.1 to 3.7 wt. % V, 0.85 to 3.15 wt. % Mo, 0.01 to 0.15 wt. % O, at least one element from the group of Fe, Ni, Co, and Cr, and balance titanium, satisfying the following equations;

0.85 wt. %≦Fe wt. %+Ni wt. %+Co wt. %+0.9×Cr wt. % ≦3.15 wt. %, 7 wt. %≦X wt. %≦13 wt. %,

X wt. %=2×Fe wt. %+2×Ni wt. %+2×Co wt. %+1.8×Cr wt. %+1.5×V+Mo wt. %; and hot working the heated alloy with the reduction ratio of at least 50%.

(4) A method of superplastic forming of a titanium base alloy for superplastic forming comprising the steps of;

heat treating the the titanium base alloy specified below to a temperature in the temperature range of from $\beta$ transus minus 250° C. to $\beta$ transus;

a titanium base alloy for superplastic forming consisting essentially of about 3.0 to 5.0 wt. % Al, 2.1 to 3.7 wt. % V, 0.85 to 3.15 wt. % Mo, 0.01 to 0.15 wt. % O, at least one element from the group of Fe, Ni, Co, and Cr, and balance titanium, satisfying the following equations;

0.85 wt. %≦Fe wt. %+Ni wt. %+Co wt. %+0.9×Cr wt. % ≦3.15 wt. %, 7 wt. %≦X wt. %≦13 wt. %,

X wt. %=2×Fe wt. %+2×Ni wt. %+2×Co wt. %+1.8×Cr wt. %+1.5×V+Mo wt. %; and superplastic forming of the heat treated alloy.

The reason of the above specifications concerning the chemical composition, the conditions of making and superplastic forming of the alloy is explained as below:

I. Chemical Composition (1) Al

Titanium alloys are produced ordinarily by hot-forging and/or hot rolling. However, when the temperature of the work is lowered, the deformation resistance is increased, and defects such as crack are liable to generate, which causes the lowering of workability.

The workability has a close relationship with content.

Al is added to titanium as $\alpha$-stabilizer for the $\alpha+\beta$-alloy, which contributes to the increase of mechanical strength. However in case that the Al content is below 3 wt. %, sufficient strength aimed in this invention can not be obtained, whereas in case that the Al content exceeds 5 wt. %, the hot deformation resistance is increased and cold workability is deteriorated, which leads to the lowering of the productivity.

Accordingly, Al content is determined to be 3.0 to 5.0% wt. %, and more preferably 4.0 to 5.0% wt. %.

(2) Fe, Ni, Co, and Cr

To obtain a titanium alloy having high strength and excellent superplastic properties, the micro-structure of the alloy should have fine equi-axed $\alpha$ crystal, and the volume ratio of the $\alpha$ crystal should range from 40 to 60%.

Therefore, at least one element from the group of Fe, Ni, Co, Or, and Mo should be added to the alloy to lower the $\beta$ transus compared with Ti—6Al—4V alloy.

As for Mo, explanation will be given later. Fe, Ni, Co, and Cr are added to titanium as $\beta$-stabilizer for the $\alpha+\beta$-alloy, and contribute to the enhancement of superplastic properties, that is, the increase of superplastic elongation, and the decrease of resistance of deformation, by lowering of $\beta$-transus, and to the increase of mechanical strength by constituting a solid solution in $\beta$-phase. By adding these elements the volume ratio of $\beta$-phase is increased, and the resistance of deformation is decreased in hot working the alloy, which leads to the evading of the generation of the defects such as cracking. However this contribution is insufficient in case that the content of these elements is below 0.1 wt. %, whereas in case that the content exceed 3.15 wt. %, these elements form brittle intermetallic compounds with titanium, and generate a segregation phase called "beta fleck" in melting and solidifying of the alloy, which leads to the deterioration of the mechanical properties, especially ductility.

Accordingly, the content of at least one element from the group of Fe, Ni, Co, Cr is determined to be from 0.1 to 3.15 wt. %.

As far as Fe content is concerned, a more preferred range is from 1.0 to 2.5 wt. %.

(3) Fe wt. %+Ni wt. %+Co wt. %+0.9×Cr wt. %

Fe wt. %+Ni wt. %+Co wt. %+0.9×Cr wt. % is an index for the stability $\beta$-phase which has a close relationship with the superplastic properties of titanium alloys, that is, the lowering of the temperature wherein superplasticity is realized and the deformation resistance in superplastic forming.

In case that this index is below 0.85 wt. %, the alloy loses the property of low temperature wherein the superplastic properties is realized which the essence of this invention, or the resistance of deformation thereof in superplastic forming is increased when the above mentioned temperature is low.

In case that this index exceeds 3.15 wt. %, Fe, Ni, Co, and Cr form brittle intermetallic compounds with titanium, and generates a segregation phase called "beta fleck" in melting and solidifying of the alloy, which leads to the deterioration of the mechanical properties, especially ductility at room temperature. Accordingly, this index is determined to be 0.85 to 3.15 wt. %, and more preferably 1.5 to 2.5 wt. %.

(4) Mo

Mo is added to titanium $\beta$-stabilizer for the $\alpha+\beta$-alloy, and contributes to the enhancement of superplastic properties, that is, the lowering of the temperature wherein the superplasticity is realized, by lowering of $\beta$-transus as in the case of Fe, Ni, Co, and Cr.

However this contribution is insufficient in case that Mo content is below 0.85 wt. %, whereas in case that Mo content exceeds 3.15 wt. %, Mo increases the specific weight of the alloy due to the fact that Mo is a heavy metal, and the property of titanium alloys as high strength/weight material is lost. Moreover Mo has low diffusion rate in titanium, which increases the deformation stress. Accordingly, Mo content is determined as 0.85~3.15 wt. %, and a preferable range is 1.5 to 3.0 wt. %.

(5) V

V is added to titanium as $\beta$-stabilizer for the $\alpha+\beta$-alloy, which contributes to the increase of mechanical strength without forming brittle intermetallic compounds with titanium. That is, V strengthens the alloy by making a solid solution with $\beta$ phase. The fact wherein the V content is within the range of 2.1 to 3.7 wt. %. In this alloy, has the merit in which the scrap of the most sold Ti—6Al—4V can be utilized. However in case that V content is below 2.1 wt. %, sufficient strength aimed in this invention can not be obtained, whereas in case that V content exceeds 3.7 wt. %, the superplastic elongation is decreased, by exceedingly lowering of the $\beta$ transus.

Accordingly, V content is determined as 2.1~3.7 wt. %, and a more preferrable range is 2.5 to 3.7 wt. %.

(6) O

O contributes to the increase of mechaniaI strength by constituting solid solution mainly in α-phase. However in case that O content is below 0.01 wt. %, the contribution is not sufficient, whereas in case that the O content exceeds 0.15 wt. %, the ductility at room temperature is deteriorated. Accordingly, the O content is determined to be 0.01 to 0.15 wt. %, and a more preferable range is 0.06 to 0.14.

(7) 2×Fe wt. %+2×Ni wt. %+2×Co wt. %+1.8×Cr wt. %+1.5×V+Mo wt. %

2×Fe wt. %+2×Ni wt. %+2×Co wt. %+1.8×Cr wt. %+1.5×V+Mo wt. % is an index showing the stability of β-phase, wherein the higher the index the lower the β transus and vice versa. The most pertinent temperature for the superplastic forming is those wherein the volume ratio of primary α-phase is from 40 to 60 percent. The temperature has close relationship With the β-transus. When the index is below 7 wt. %, the temperature wherein the superplastic properties are realized, is elevated, which diminishes the advantage of the invented alloy as low temperature and the contribution thereof to the enhancement of the room temperature strength. When the index exceeds 13 wt. %, the temperature wherein the volume ratio of primary α-phase is from 40 to 60 percent becomes too low, which causes the insufficient diffusion and hence insufficient superplastic elongation. Accordingly, 2×Fe wt. %+2×Ni wt. %+2×Co wt. %+1.8×Cr wt. %1.5×V+Mo wt. % is determined to be 7 to 13 wt. %, and a more preferable range is 9 to 11 wt. %.

II. The Grain Size of α-Crystal

When superplastic properties are required, the grain size of the α is preferred to be below 5 μm.

The grain size of the α-crystal has a close relationship with the superplastic properties, the smaller the grain size the better the superplastic properties. In this invention, in the case that the grain size of α-crystal exceeds 5 μm, the superplastic elongation is decreased and the resistance of deformation is increased. The superplastic forming is carried out by using comparatively small working force, e.g. by using low gas pressure. Hence smaller resistance of deformation is required.

Accordingly, the grain size of α-crystal is determined as be low 5 μm, and a more preferable range is below 3 μm.

III. The Conditions of Making the Titanium Alloy (1) The conditions of hot working The titanium alloy having the chemical composition specified in I is formed by hot forging, hot rolling, or hot extrusion, after the cast structure of the alloy is broken down by forming or slabing and the structure is made uniform. At the stage of the hot working, in case that the reheating temperature of the work is below β transus minus 250° C., the deformation resistance becomes excessively large or the defects such as crack may be generated. When the temperature exceeds β-transus, the grain of the crystal becomes coarse which causes the deterioration of the hot workability such as generation of crack at the grain boundary.

When the reduction ratio is below 50%, the sufficient strain is not accumulated in the α-crystal, and the fine equi-axed micro-structure is not obtained, whereas the α-crystal stays elongated or coarse. These structures are not only unfavorable to the superplastic deformation, but also inferior in hot workability and cold workability. Accordingly, the reheating temperature at the stage of working is to be from β-transus minus 250° C. to β-transus, and the reduction ratio is at least 50%, and more preferably at least 70%.

(2) Heat treatment

This process is required for obtaining the equi-axed fine grain structure in the superplastic forming of the alloy. When the temperature of the heat treatment is below β-transus minus 250° C., the recrystalization is not sufficient, and equi-axed grain cannnot be obtained. When the temperature exceeds β-transus, the microstructure becomes β-phase, and equi-axed α-crystal vanishes, and superplastic properties are not obtained. Accordingly the heat treatment temperature is to be from β-transus minus 250° C. to β-transus.

This heat treatment can be done before the superplastic forming in the forming apparatus.

EXAMPLES

Example 1

Tables 1, 2, and 3 show the chemical composition, the grain size of α-crystal, the mechanical properties at room temperature, namely, 0.2% proof stress, tensile strength, and elongation, the maximum cold reduction ratio without edge cracking, and the superplastic properties, namely, the maximum superplastic elongation, the temperature wherein the maximum superplastic deformation is realized, the maximum stress of deformation at said temperature and the resistance of deformation in hot compression at 700° C., of invented titanium alloys; A1 to A28, of conventional Ti—6Al—4V alloys; B1 to B4, of titanium alloys for comparison; C1 to C20. These alloys are molten and worked in the following way.

TABLE 1

| | Test Nos. | Chemical Composition (wt. %) (Balance: Ti) | | | | | | | | Chemical Composition (wt. %) (Balance: Ti) | | Grain Size of α-Crystal (μm) |
|---|---|---|---|---|---|---|---|---|---|---|---|---|
| | | Al | V | Mo | O | Fe | Ni | Co | Cr | Fe + Ni + Co + 0.9 Cr | 2 Fe + 2 Ni + 2 Co + 1.8 Cr + 1.5V + Mo | |
| Alloys of Present Invention | A1 | 4.65 | 3.30 | 1.68 | 0.11 | 2.14 | — | — | — | 2.14 | 10.9 | 2.3 |
| | A2 | 3.92 | 3.69 | 3.02 | 0.12 | 0.96 | — | — | — | 0.96 | 10.5 | 1.9 |
| | A3 | 4.03 | 2.11 | 0.88 | 0.09 | 3.11 | — | — | — | 3.11 | 10.3 | 3.7 |
| | A4 | 4.93 | 2.17 | 2.37 | 0.03 | 0.91 | — | — | — | 0.91 | 7.1 | 2.8 |
| | A5 | 3.07 | 2.82 | 1.17 | 0.13 | 1.79 | — | — | — | 1.79 | 9.0 | 3.3 |
| | A6 | 3.97 | 2.97 | 2.02 | 0.08 | 1.91 | — | — | — | 1.91 | 10.3 | 2.1 |
| | A7 | 3.67 | 2.54 | 0.97 | 0.05 | 2.81 | — | — | — | 2.81 | 10.4 | 4.6 |
| | A8 | 4.16 | 3.50 | 1.65 | 0.04 | 2.90 | — | — | — | 2.90 | 12.7 | 2.8 |
| | A9 | 3.42 | 3.26 | 1.76 | 0.07 | 2.53 | — | — | — | 2.53 | 11.7 | 3.0 |
| | A10 | 4.32 | 2.99 | 2.03 | 0.09 | — | 1.74 | — | — | 1.77 | 10.1 | 3.7 |
| | A11 | 3.97 | 3.14 | 1.86 | 0.12 | — | — | 1.94 | — | 1.94 | 10.5 | 4.0 |
| | A12 | 4.03 | 3.27 | 2.29 | 0.06 | — | — | — | 0.99 | 0.89 | 9.0 | 4.2 |
| | A13 | 4.37 | 3.11 | 2.15 | 0.10 | — | — | — | 1.87 | 1.68 | 10.2 | 3.3 |
| | A14 | 4.02 | 2.76 | 2.07 | 0.08 | — | — | — | 2.24 | 2.02 | 10.2 | 3.0 |
| | A15 | 4.03 | 2.85 | 2.21 | 0.07 | — | — | — | 2.75 | 2.48 | 9.0 | 3.8 |

TABLE 1-continued

| | Test Nos. | Chemical Composition (wt. %) (Balance: Ti) Al | V | Mo | O | Fe | Ni | Co | Cr | Chemical Composition (wt. %) (Balance: Ti) Fe + Ni + Co + 0.9 Cr | 2 Fe + 2 Ni + 2 Co + 1.8 Cr + 1.5V + Mo | Grain Size of α-Crystal (μm) |
|---|---|---|---|---|---|---|---|---|---|---|---|---|
| | A16 | 3.54 | 3.17 | 2.27 | 0.07 | 0.86 | — | — | 1.56 | 2.26 | 11.6 | 3.2 |
| | A17 | 4.23 | 3.43 | 2.31 | 0.08 | 1.66 | — | — | 0.96 | 2.52 | 12.5 | 2.2 |
| | A18 | 3.97 | 2.67 | 1.86 | 0.07 | 1.21 | — | — | 1.06 | 2.16 | 10.2 | 3.5 |
| | A19 | 3.72 | 3.04 | 1.77 | 0.09 | — | 0.32 | — | 2.62 | 2.68 | 11.7 | 3.6 |
| | A20 | 4.36 | 3.11 | 2.04 | 0.11 | 1.74 | — | 0.74 | — | 2.48 | 11.7 | 2.5 |
| | A21 | 4.21 | 2.56 | 2.27 | 0.06 | — | — | 0.97 | 2.32 | 3.06 | 12.2 | 2.9 |
| | A22 | 3.67 | 2.86 | 2.31 | 0.05 | 0.96 | 0.62 | — | — | 1.58 | 9.8 | 3.4 |
| | A23 | 4.11 | 3.07 | 2.17 | 0.08 | — | 0.82 | 0.97 | — | 1.79 | 10.4 | 3.6 |
| | A24 | 3.82 | 2.77 | 1.96 | 0.12 | 0.76 | 0.27 | — | 0.42 | 1.41 | 8.9 | 4.1 |
| | A25 | 4.40 | 2.96 | 1.83 | 0.09 | 1.21 | — | 0.41 | 0.67 | 2.22 | 10.7 | 3.9 |
| | A26 | 3.96 | 2.57 | 2.06 | 0.04 | 0.67 | 0.31 | 0.87 | 1.06 | 2.80 | 11.5 | 3.6 |
| | A27 | 4.61 | 3.97 | 2.11 | 0.08 | 1.07 | — | — | — | 1.07 | 10.2 | 6.8 |
| | A28 | 4.32 | 2.99 | 1.07 | 0.09 | 1.06 | — | — | — | 1.06 | 7.7 | 9.0 |
| Prior Art Alloys | B1 | 6.03 | 4.25 | — | 0.17 | 0.25 | — | — | — | 0.25 | 6.9 | 6.2 |
| | B2 | 6.11 | 4.07 | — | 0.12 | 0.08 | — | — | — | 0.08 | 6.3 | 6.7 |
| | B3 | 6.17 | 4.01 | — | 0.19 | 1.22 | — | 0.91 | — | 2.13 | 6.0 | 3.5 |
| | B4 | 6.24 | 3.93 | — | 0.19 | 0.22 | 0.93 | 0.88 | — | 2.03 | 10.0 | 4.1 |
| Alloys for Comparison | C1 | 2.96 | 3.01 | 0.87 | 0.06 | 0.91 | — | — | — | 0.91 | 7.2 | 5.3 |
| | C2 | 5.27 | 3.17 | 1.78 | 0.12 | 1.69 | — | — | — | 1.69 | 9.9 | 3.2 |
| | C3 | 4.21 | 2.78 | 0.82 | 0.07 | 1.03 | — | — | — | 1.03 | 7.1 | 6.2 |
| | C4 | 3.17 | 2.21 | 3.21 | 0.08 | 2.99 | — | — | — | 2.99 | 12.5 | 3.9 |
| | C5 | 3.06 | 2.99 | 1.18 | 0.09 | 0.81 | — | — | — | 0.81 | 7.3 | 4.8 |
| | C6 | 3.66 | 2.11 | 3.00 | 0.11 | 3.27 | — | — | — | 3.27 | 12.7 | 2.7 |
| | C7 | 3.21 | 2.01 | 2.25 | 0.06 | 0.87 | — | — | — | 0.87 | 7.0 | 3.7 |
| | C8 | 4.67 | 3.82 | 1.79 | 0.07 | 2.44 | — | — | — | 2.44 | 12.4 | 4.6 |
| | C9 | 4.57 | 3.91 | 1.34 | 0.16 | 1.78 | — | — | — | 1.78 | 10.8 | 5.0 |
| | C10 | 3.07 | 2.11 | 2.75 | 0.11 | 0.92 | — | — | — | 0.92 | 7.8 | 5.6 |
| | C11 | 4.87 | 2.69 | 0.86 | 0.07 | 0.90 | — | — | — | 0.90 | 6.7 | 4.6 |
| | C12 | 3.21 | 4.05 | 2.40 | 0.10 | 2.46 | — | — | — | 2.46 | 13.4 | 3.7 |
| | C13 | 4.17 | 3.08 | 1.21 | 0.08 | — | — | — | 0.65 | 0.59 | 7.0 | 4.9 |
| | C14 | 3.76 | 2.14 | 2.76 | 0.10 | — | — | — | 3.85 | 3.47 | 12.9 | 3.2 |
| | C15 | 3.86 | 2.76 | 1.96 | 0.13 | 0.13 | — | — | 0.42 | 0.51 | 7.1 | 4.4 |
| | C16 | 4.10 | 2.11 | 0.96 | 0.11 | — | 3.43 | — | — | 3.43 | 11.0 | 6.0 |
| | C17 | 3.95 | 2.24 | 1.07 | 0.08 | — | — | 3.52 | — | 3.52 | 11.5 | 5.5 |
| | C18 | 4.08 | 3.06 | 1.79 | 0.07 | 2.14 | — | — | 1.52 | 3.51 | 13.4 | 4.8 |
| | C19 | 4.13 | 2.61 | 1.43 | 0.13 | 0.11 | 0.14 | 0.13 | 0.11 | 0.48 | 6.3 | 5.8 |
| | C20 | 3.87 | 3.31 | 2.04 | 0.08 | 1.76 | 0.86 | 0.72 | 0.31 | 3.62 | 14.2 | 3.0 |

TABLE 2

| | Test Nos. | Tensile Properties at Room Temperature 0.2% PS (kgf/mm²) | TS | EL (%) |
|---|---|---|---|---|
| Alloys of Present Invention | A1 | 94.5 | 98.0 | 20.0 |
| | A2 | 93.1 | 96.3 | 20.9 |
| | A3 | 90.3 | 93.6 | 21.8 |
| | A4 | 95.1 | 99.0 | 17.8 |
| | A5 | 88.7 | 92.0 | 21.9 |
| | A6 | 93.6 | 96.8 | 20.7 |
| | A7 | 94.7 | 97.9 | 19.6 |
| | A8 | 96.7 | 100.4 | 17.2 |
| | A9 | 95.0 | 98.3 | 17.8 |
| | A10 | 93.9 | 97.1 | 19.8 |
| | A11 | 94.3 | 97.3 | 18.9 |
| | A12 | 90.3 | 94.1 | 21.7 |
| | A13 | 94.1 | 97.6 | 20.6 |
| | A14 | 92.3 | 94.9 | 21.1 |
| | A15 | 93.6 | 96.2 | 20.5 |
| | A16 | 95.1 | 98.5 | 17.1 |
| | A17 | 96.7 | 100.5 | 17.2 |
| | A18 | 92.8 | 96.2 | 21.3 |
| | A19 | 92.9 | 96.4 | 20.8 |
| | A20 | 95.1 | 98.7 | 17.2 |
| | A21 | 95.4 | 99.0 | 17.0 |
| | A22 | 94.4 | 97.3 | 20.0 |
| | A23 | 95.0 | 98.0 | 19.0 |
| | A24 | 91.9 | 95.7 | 22.5 |
| | A25 | 93.9 | 97.5 | 21.0 |
| | A26 | 94.0 | 97.2 | 21.0 |

TABLE 2-continued

| | Test Nos. | Tensile Properties at Room Temperature 0.2% PS (kgf/mm²) | TS | EL (%) |
|---|---|---|---|---|
| | A27 | 98.2 | 104.0 | 13.7 |
| | A28 | 94.6 | 99.6 | 19.4 |
| Prior Art Alloys | B1 | 85.9 | 93.3 | 18.9 |
| | B2 | 82.7 | 90.1 | 20.2 |
| | B3 | 104.2 | 108.5 | 17.4 |
| | B4 | 102.5 | 106.8 | 21.0 |
| Alloys for Comparison | C1 | 85.3 | 89.7 | 22.0 |
| | C2 | 98.7 | 105.7 | 12.7 |
| | C3 | 83.7 | 88.6 | 20.5 |
| | C4 | 101.9 | 107.6 | 11.7 |
| | C5 | 86.1 | 89.9 | 20.6 |
| | C6 | 100.6 | 110.4 | 13.2 |
| | C7 | 93.7 | 97.4 | 20.1 |
| | C8 | 96.4 | 103.4 | 16.7 |
| | C9 | 99.6 | 106.3 | 16.1 |
| | C10 | 90.5 | 94.7 | 21.4 |
| | C11 | 85.6 | 90.7 | 19.0 |
| | C12 | 103.6 | 107.9 | 14.2 |
| | C13 | 92.7 | 96.4 | 17.1 |
| | C14 | 102.1 | 104.7 | 8.7 |
| | C15 | 90.4 | 93.7 | 21.1 |
| | C16 | 103.1 | 104.9 | 4.6 |
| | C17 | 102.9 | 105.0 | 5.1 |
| | C18 | 103.7 | 106.1 | 8.3 |
| | C19 | 90.7 | 93.3 | 21.1 |
| | C20 | 103.6 | 105.7 | 6.0 |

TABLE 3

| | Test Nos. | Cold Reduction Ratio without Edge Cracking (%) | Maximum Superplastic Elongation (%) | Temperature, at which Maximum Elongation is Shown (°C.) | Deformation Stress at Temperature, at which Maximum Elongation is Shown (kgf/mm$^2$) | Deformation Stress in Hot Compression Test (kgf/mm$^2$) |
|---|---|---|---|---|---|---|
| Alloys of Present Invention | A1 | 55 | 2040 | 775 | 1.45 | 24 |
| | A2 | 65 | 2250 | 750 | 1.61 | 22 |
| | A3 | 60 | 1680 | 775 | 1.38 | 21 |
| | A4 | 50 | 1970 | 800 | 1.08 | 24 |
| | A5 | 70 or more | 1750 | 775 | 1.39 | 20 |
| | A6 | 60 | 1860 | 775 | 1.44 | 23 |
| | A7 | 65 | 1710 | 775 | 1.47 | 21 |
| | A8 | 55 | 1690 | 775 | 1.26 | 24 |
| | A9 | 65 | 1855 | 750 | 1.58 | 22 |
| | A10 | 55 | 1700 | 775 | 1.36 | 23 |
| | A11 | 60 | 1800 | 775 | 1.32 | 21 |
| | A12 | 70 or more | 1610 | 800 | 1.30 | 22 |
| | A13 | 50 | 1720 | 775 | 1.43 | 24 |
| | A14 | 60 | 2010 | 775 | 1.39 | 22 |
| | A15 | 55 | 2000 | 775 | 1.37 | 22 |
| | A16 | 65 | 1850 | 775 | 1.28 | 21 |
| | A17 | 50 | 1900 | 750 | 1.25 | 24 |
| | A18 | 60 | 2050 | 800 | 1.10 | 23 |
| | A19 | 60 | 1760 | 750 | 1.48 | 23 |
| | A20 | 50 | 1810 | 775 | 1.22 | 24 |
| | A21 | 55 | 1630 | 750 | 1.47 | 23 |
| | A22 | 70 or more | 1820 | 800 | 1.07 | 20 |
| | A23 | 60 | 1650 | 775 | 1.33 | 24 |
| | A24 | 70 or more | 1750 | 800 | 1.11 | 23 |
| | A25 | 55 | 1890 | 775 | 1.32 | 24 |
| | A26 | 65 | 1580 | 750 | 1.43 | 23 |
| | A27 | 50 | 1310 | 775 | 1.62 | 24 |
| | A28 | 55 | 970 | 775 | 1.69 | 24 |
| Prior Art Alloys | B1 | 10 or less | 982 | 875 | 1.25 | 37 |
| | B2 | 10 or less | 925 | 900 | 1.03 | 35 |
| | B3 | 10 or less | 1328 | 825 | 1.07 | 30 |
| | B4 | 10 or less | 1385 | 825 | 1.02 | 31 |
| Alloys for Comparison | C1 | 70 or more | — | — | — | — |
| | C2 | 30 | — | — | — | 29 |
| | C3 | 50 | — | — | — | 25 |
| | C4 | 45 | 750 | 750 | 2.27 | 27 |
| | C5 | 70 or more | — | — | — | — |
| | C6 | 40 | 700 | 750 | 2.31 | 28 |
| | C7 | 60 | 1220 | 775 | 1.45 | 26 |
| | C8 | 20 | — | — | — | — |
| | C9 | 10 or less | — | — | — | — |
| | C10 | 60 | 1320 | 775 | 1.52 | 25 |
| | C11 | 30 | 1625 | 850 | 1.07 | 28 |
| | C12 | 70 or less | 1225 | 750 | 2.01 | 27 |
| | C13 | 60 | 1250 | 850 | 1.00 | 28 |
| | C14 | 10 or less | — | — | — | — |
| | C15 | 55 | 1500 | 850 | 1.08 | 28 |
| | C16 | 30 | — | — | — | — |
| | C17 | 30 | — | — | — | — |
| | C18 | 40 | 1050 | 750 | 2.22 | 27 |
| | C19 | 50 | 1250 | 850 | 1.12 | 29 |
| | C20 | 20 | — | — | — | — |

The ingots are molten in an arc furnace under argon atmosphere, which are hot forged and hot rolled into plates with thickness of 50 min. At the working stage, the reheating temperature is of the $\alpha+\beta$ dual phase and the reduction ratio is 50 to 80%. After the reduction, the samples are treated by a recrystalization annealing in the temperature range of the $\alpha+\beta$ dual phase.

The samples from these plates are tested concerning the mechanical properties at room temperature, namely. 0.2% proof stress, tensile strength, and elongation, as shown in Table 2.

As for the tensile test for superplasticity, samples are cut out of the plates with dimensions of the pararell part; 5 mm width by 5 mm length by 4 mm thickness and tested under atmospheric pressure of $5.0\times10^{-6}$ Torr. The test results are shown in Table 3, denoting the maximum superplastic elongation, the temperature wherein the maximum superplastic elongation is realized, the maximum deformation stress at said temperature, and the deformation resistance in hot compression at 700° C. of the samples shown in Table 1. The maximum deformation stress is obtained by dividing the maximum test load by original sectional area.

The test results of resistance of deformation in hot compression are shown in Table 3. In this test cylindrical specimens are cut out from the hot rolled plate. The specimens are hot compressed at 700° C. under vacuum atmosphere. The test results are evaluated by the value of true stress when the samples are compressed with the reduction ratio of 50%. The invented alloys have the value of below 24 kgf/mm$^2$ which is superior to those of the conventional alloy, Ti—4V—6Al and the alloys for comparison.

This hot compression test was not carried out for the alloys for comparison C1, C3, and C5 since the values of the tensile test at room temperature are below 9.0 kgf/mm$^2$ which is lower than those of Ti—6Al—4V, and not for the alloys for comparison, C2, C8, C9, C14, C16, C17, and C20 since the maximum cold reduction ratio without edge cracking is below 301; which is not in the practical range.

FIGS. 1 to 5 are the graphs of the test results.

Figure 1:
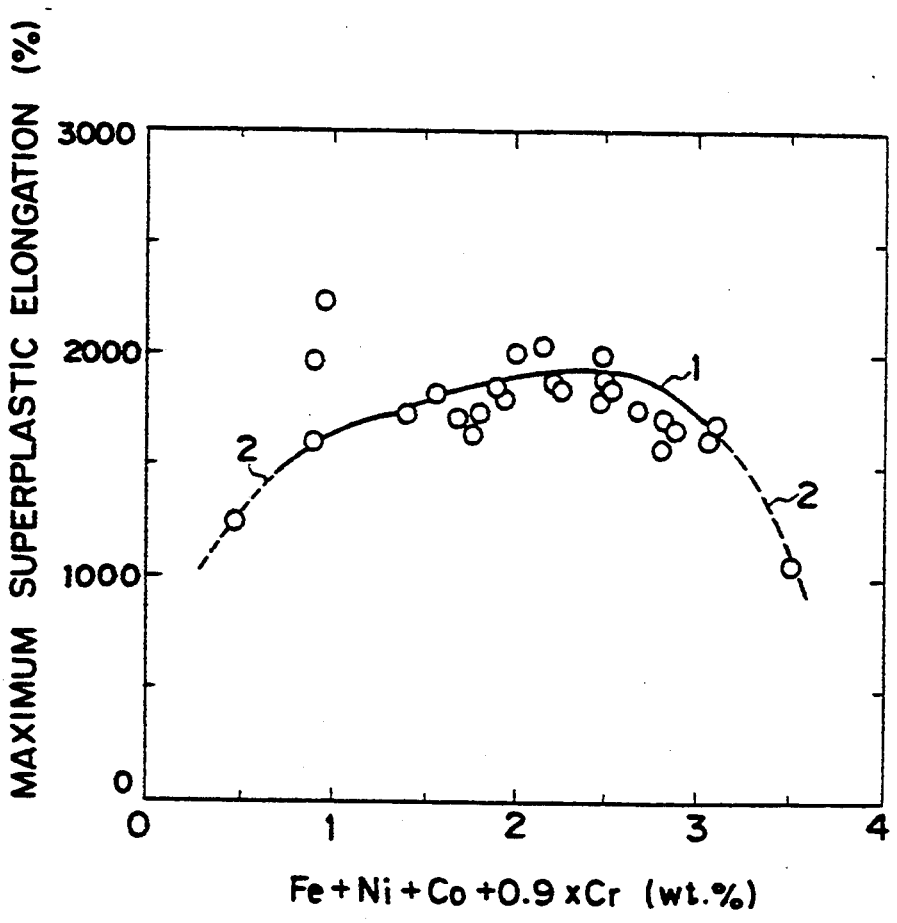
FIG. 1 shows the change of the maximum superplastic elongation of the titanium alloys with respect to the addition Fe, Ni, Co, and Cr to Ti—Al—V—Mo alloy. The abscissa denotes Fe wt. %+Ni wt. %+Co wt. %+0.9×Cr wt. %, and the ordinate denotes the maximum superplastic elongation.

FIG. 1 shows the change of the maximum superplastic elongation of the titanium alloys with respect to the addition of Fe, Ni, Co, and Cr to Ti—Al—V—Mo alloy.

The abscissa denotes Fe wt. %+Ni wt. %+Co wt. %+0.9×Cr wt. %, and the ordinate denotes the maximum superplastic elongation. As is shown in FIG. 1, the maximum superplastic elongation of over 1500% is obtained in the range of 0.85 to 3.15 wt. % of the value of Fe wt. %+Ni wt. %+Co wt. %+0.9×Cr wt. %, and higher values are observed in the range of 1.5 to 2.5 wt. %.

Figure 2:
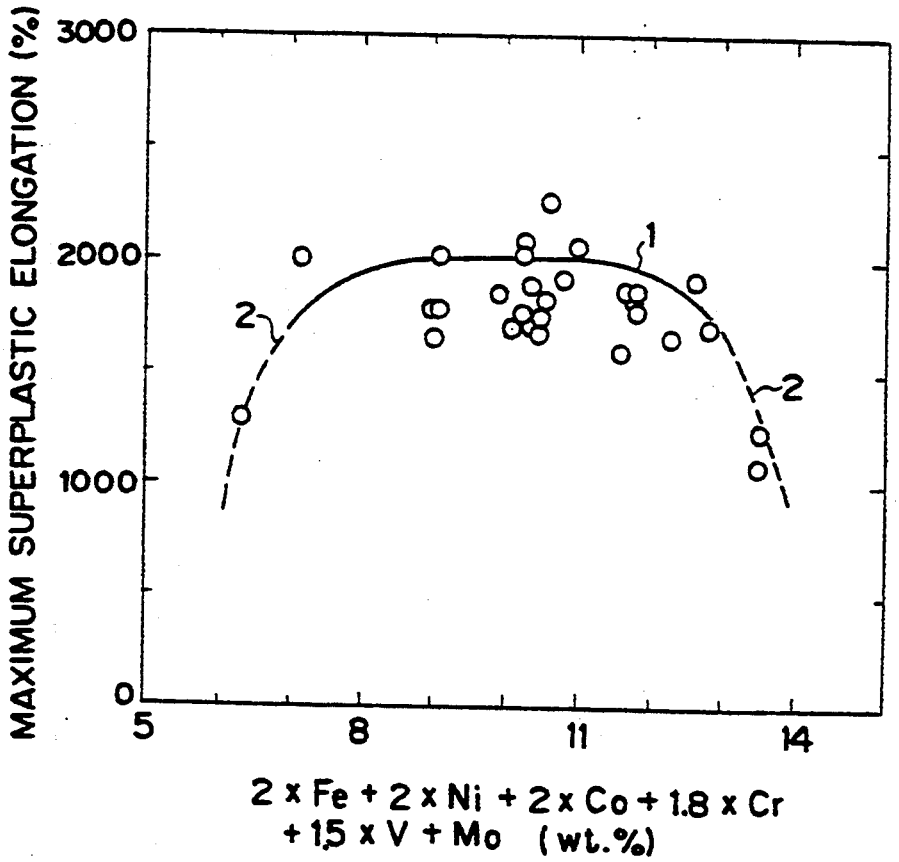
FIG. 2 shows the change of the maximum superplastic elongation of the titanium alloys with respect to the addition of V, Mo, Fe, Ni, Co, and Cr to Ti—Al alloy.

FIG. 2 shows the change of the maximum superplastic elongation of the titanium alloys with respect to the addition of V, Mo, Fe, Ni, Co, and Cr to Ti—Al alloy. The abscissa denotes 2×Fe wt. %+2×Ni wt. %+2×Co wt. %+1.8×Cr wt. %+15×V wt. %+Mo. wt. %, and the ordinate denotes the maximum superplastic elongation. As shown in FIG. 2, the maximum superplastic elongation of over 1500% is obtained in the range of 7 to 13 wt. % of the value of 2×Fe wt. %+2×Ni wt. %+2×Co wt. %+1.8×Cr wt. %+1.5×V wt. %+Mo wt. %, and higher values are observed in the range of 9 to 11 wt. %. When the index is below 7 wt. %, the temperature wherein the maximum superplastic elongation is realized, is 850° C.

FIG. 3 shows the change of the maximum superplastic elongation of the titanium alloys, having the same chemical, composition with those of the invented alloys, with respect to the change of the grain size of α-crystal thereof. The abscissa denotes the grain size of α-crystal of the titanium alloys, and the ordinate denotes the maximum superplastic elongation.

As shown in the FIG. 3, large elongations of over 1500% are obtained in case that the grain size of α-crystal is 5 μm or less, and higher values are observed below the size of 3 μm.

FIG. 4 shows the influence of Al content on the maximum cold reduction ratio without edge cracking. The abscissa denotes Al wt. %, and the ordinate denotes the maximum cold reduction ratio without edge cracking.

As shown in the FIG. 4, the cold rolling, with the cold reduction ratio of more than 50% is possible, when the Al content is below 5 wt. %.

As shown in Tables 2 and 3, the tensile properties of the invented alloys A1 to A28 are 92 kgf/mm$^2$ or more in tensile strength, 13% or more in elongation, and the alloys possess the tensile strength and the ductility equal to or superior to Ti—6Al—4V alloys. The invented alloys can be cold rolled with the reduction ratio of more than 50%.

Furthermore, in case of the invented alloys A1 to 26 having the grain size of the crystal of below 5 μm, the temperature wherein the maximum superplastic elongation is realized is as low as 800° C., and the maximum superplastic elongation at the temperature is over 1500%, whereas in case of the alloys for comparison, the superplastic elongation is around 1000% or less, or 1500% in C15, however, the temperature for the realization of superplasticity in C15 is 850° C. Accordingly, the invented alloys are superior to the alloys for comparison in superplastic properties.

In case of the alloys for comparison C1, C3, and C5, the superplastic tensile test is not carried out since the result of the room temperature tensile test thereof is 90 kgf/m$^2$ which is inferior to that of Ti—6Al—4V alloy.

In case of the alloys for comparison C2, C8, C9, C14, C16, C17, and C20, the superplastic tensile test is not carried out since the maximum cold reduction ratio without edge cracking thereof is below 30%, and out of the practical range.

Example 2

For the titanium alloys D1, D2, and D3 with the chemical composition shown in Table 4, the hot working and heat treatment are carried out according to the conditions specified in Table 5, and the samples are tested as for the superplastic tensile properties, cold reduction test, and hot workability test.

TABLE 4

| | Chemical Composition (wt. %) (Balance: Ti) | | | | | | | | Chemical Composition (wt. %) (Balance: Ti) | |
|---|---|---|---|---|---|---|---|---|---|---|
| | Al | V | Mo | O | Fe | Ni | Co | Cr | Fe + Ni + Co + 0.9 Cr | 2 Fe + 2 Ni + 2 Co + 1.8 Cr + 1.5V + Mo |
| D1 | 4.65 | 3.30 | 1.68 | 0.11 | 2.14 | — | — | — | 2.14 | 10.9 |
| D2 | 4.02 | 2.76 | 2.07 | 0.08 | — | — | — | 2.24 | 2.02 | 10.2 |
| D3 | 3.82 | 2.77 | 1.96 | 0.12 | 0.76 | 0.27 | — | 0.42 | 1.41 | 8.9 |

TABLE 5

| | | β-Transus (°C.) | Final Hot Working: Heating Temp. (°C.) | Final Hot Working: Reduction Ratio | Final Hot Working: Crack | Temperature of Heat Treatment (°C.) | Maximum Superplastic Elongation (%) | Hot Workability Test |
|---|---|---|---|---|---|---|---|---|
| D1 | 1 | 915 | 600 | 4 | Crack | — | — | — |
| | 2 | | 800 | 4 | No Crack | 775 | 2040 | No Crack |
| | 3 | | 1100 | 4 | Crack | — | — | — |
| | 4 | | 800 | 1.5 | No Crack | 775 | 1450 | Crack |
| | 5 | | 800 | 4 | No Crack | 1000 | 500 | Crack |
| D2 | 1 | 910 | 650 | 4 | Crack | — | — | — |
| | 2 | | 850 | 4 | No Crack | 775 | 2010 | No Crack |
| | 3 | | 850 | 4 | No Crack | 950 | 600 | No Crack |
| D3 | 1 | 920 | 850 | 4 | No Crack | 800 | 1750 | No Crack |

TABLE 5-continued

| | β-Transus (°C.) | Final Hot Working Heating Temp. (°C.) | Reduction Ratio | Crack | Temperature of Heat Treatment (°C.) | Maximum Superplastic Elongation (%) | Hot Workability Test |
|---|---|---|---|---|---|---|---|
| 2 | | 850 | 1.8 | No Crack | 800 | 1250 | Crack |
| 3 | | 850 | 4 | No Crack | 600 | 1450 | No Crack |
| 4 | | 850 | 4 | No Crack | 1000 | 700 | Crack |

The method of the test as for the superplastic properties and the cold reduction without edge cracking is the same with that shown in Example 1. The hot workability test is carried out with cyrindrical specimens having the dimensions; 6 mm in diameter, 10 mm in height with a notch pararell to the axis of the cylinder having the depth of 0.8 mm, at the temperature of about 700° C., compressed with the reduction of 50%. The criterion of this test is the genaration crack.

The heat treatment and the superplastic tensile test and the other tests are not carried out as for the samples D1-1, D1-3, and D2-1, since cracks are generated on these samples after the hot working.

FIG. 5 shows the relationship between the hot reduction ratio and the maximum superplastic elongation.

The abscissa denotes the reduction ratio and the ordinate denotes the maximum superplastic elongation.

In this figure the samples are reheated to the temperature between the β-transus minus 250° C. and β-transus. The samples having the reduction ratio of at least 50% possesses the maximum superplastic elongation of over 1500%, and in case of the ratio of at least 70%, the elongation is over 1700%. The results are also shown in Table 5.

As shown in Table 5, as for the samples of which reheating temperature is within the range of from β-transus minus 250° C. to β-transus and of which reduction ratio exceeds 50%, heat treatment condition being from β-transus minus 200° C. to β-transus in reheating temperature, the value of the maximum superplastic elongation exceeds 1500%, and the maximum cold reduction ratio without edge cracking is at least 50%. As for the samples of which conditions are out of the above specified range, the value of the maximum superplastic elongation is below 1500%, and cracks are generated on the notched cylindrical specimens for evaluating the hot workability, or the maximum cold reduction ratio without edge cracking is below 50%.

Example 3

Table 7 shows the results of the deformation resistance of hot compression of the invented and conventional alloys with the chemical composition specified in Table 6.

TABLE 6

(wt. %) (balance Ti)

| | Al | V | Mo | O | Fe | Cr | |
|---|---|---|---|---|---|---|---|
| E1 | 4.65 | 3.30 | 1.68 | 0.11 | 2.14 | — | Alloys of the |
| E2 | 3.97 | 2.67 | 1.68 | 0.07 | 1.21 | 1.06 | Present Invention |
| E3 | 6.11 | 4.07 | — | 0.12 | 0.08 | — | Conventional Alloy |

TABLE 7

| | Temperature Strain Rate | 600° C. $10^{-3}$ ($S^{-1}$) | 600° C. 1 ($S^{-1}$) | 800° C. $10^{-3}$ ($S^{-1}$) | 800° C. 1 ($S^{-1}$) |
|---|---|---|---|---|---|
| E1 | Deformation | 20.0 | 38.8 | 3.2 | 15.0 |

TABLE 7-continued

| | Temperature Strain Rate | 600° C. $10^{-3}$ ($S^{-1}$) | 600° C. 1 ($S^{-1}$) | 800° C. $10^{-3}$ ($S^{-1}$) | 800° C. 1 ($S^{-1}$) |
|---|---|---|---|---|---|
| E2 | Stress | 19.5 | 36.9 | 3.0 | 14.6 |
| E3 | (kgf/mm$^2$) | 32.1 | 62.1 | 7.6 | 22.0 |

The samples with the dimensions; 8 mm in diameter and 12 mm in height, are tested by applying compressive force thereon under vacuum atmosphere, and the true strain true stress curves are obtained. The values shown in Table 7 are the stresses at the strain of 50%.

The stress values of the invented alloy are smaller than those of the conventional alloy by 30 to 50%, both at higher strain rate, 1 $s^{-1}$ and at lower strain rate, $10^{-3}$ $s^{-1}$, and both at 600° C. and 800° C., which proves the invented alloy having the superior workability not only in superplastic forming but in iso-thermal forging and ordinary hot forging.

What is claimed is:

1. A method of making a titanium base alloy comprising the steps of:

heating a titanium base alloy to a temperature ranging from β-transus minus 250° C. to β-transus;

the titanium base alloy consisting essentially of about 3.42 to 5 wt. % Al, 2.1 to 3.7 wt. % V, 0.85 to 2.37 wt. % Mo, at least 0.01 wt. % O, at least one element selected from the group consisting of Fe, Co, and Cr, and the balance being titanium, and satisfying the following equations:

$$0.85 \text{ wt. } \% \leqq X \text{ wt. } \% \leqq 3.15 \text{ wt. } \%,$$

$$7 \text{ wt. } \% \leqq Y \text{ wt. } \% \leqq 13 \text{ wt. } \%,$$

$$X \text{ wt. } \% = Fe \text{ wt. } \% + Co \text{ wt. } \% + 0.9\ Cr \text{ wt. } \%$$

$$Y \text{ wt. } \% = 2 \times Fe \text{ wt. } \% + 2 \times Co \text{ wt. } \% + 1.8 \times Cr \text{ wt. } \% + 1.5 \times V \text{ wt. } \% + Mo \text{ wt. } \%, \text{ and}$$

hot working the heated alloy with a reduction ratio of at least 50%.

2. The method of claim 1, wherein the reduction ratio percent of hot working is at least 70%.

3. The method of claim 1, wherein the Al content is 4 to 5 wt. %.

4. The method of claim 1, wherein the V content is 2.5 to 3.7 wt. %.

5. The method of claim 1, wherein the Mo content is 1.5 to 2.37 wt. %.

6. The method of claim 1, wherein the Al content is 4 to 5 wt. %, the V content is 2.5 to 3.7 wt. % and the Mo content is 1.5 to 2.37 wt. %.

7. The method of claim 1, wherein the X wt. % is specified as follows:

$$1.5 \text{ wt. } \% \leqq X \leqq 2.5 \text{ wt. } \%.$$

8. The method of claim 1, wherein the Y wt. % is specified as follows:

9 wt. %≦11 wt. %.

9. The method of claim 1, wherein the X wt. % and Y wt. % are specified as follows:

1.5 wt. %≦X≦2.5 wt. %; and 9 wt. %≦Y≦11 wt. %.

10. The method of claim 1, wherein the group consists of Fe and Co.

11. The method of claim 1, wherein the group consists of Fe and Cr.

12. The method of claim 1, wherein the group consists of Fe.

13. The method of claim 1, wherein the O content is 0.01 to 0.15 wt. %.

14. The method of claim 6, wherein the X wt. % and Y wt. % are specified as follows:

1.5 wt. %≦X≦2.5 wt. %; and 9 wt. %≦Y≦11 wt. %.

15. The method of claim 10, wherein the Al content is 4 to 5 wt. %, the V content is 2.5 to 3.7 wt. %, and the Mo content is 1.5 to 2.37 wt. %.

16. The method of claim 11, wherein the Al content is 4 to 5 wt. %, the V content is 2.5 to 3.7 wt. %, and the Mo content is 1.5 to 2.37 wt. %.

17. The method of claim 12, wherein the Fe content is 1 to 2.5 wt. %.

18. The method of claim 12, wherein the Al content is 4.0 to 5.0 wt. %, the V content is 2.5 to 3.7 wt. %, and the Mo content is 1.5 to 2.37 wt. %.

19. The method of claim 17, wherein the Fe content is 1.5 to 2.5 wt. %.

20. The method of claim 17, wherein the Al content is 4.0 to 5.0 wt. %, the V content is 2.5 to 3.7 wt. %, and the Mo content is 1.5 to 2.37 wt. %.

21. The method of claim 19, wherein the Al content is 4.0 to 5.0 wt. %, the V content is 2.5 to 3.7 wt. %, and the Mo content is 1.5 to 2.37 wt. %.

22. The method of claim 20, wherein the Y wt. % is specified as follows:

9 wt. %≦Y≦11 wt. %.

23. A method of superplastic forming of a titanium base alloy for superplastic forming comprising the steps of:

heat treating a titanium base alloy to a temperature ranging from β-transus minus 250° C. to β-transus;

the titanium base alloy consisting essentially of about 3.42 to 5 wt. % Al, 2.1 to 3.7 wt. % V, 0.85 to 2.37 wt. % Mo, at least 0.01 wt. % O, at least one element selected from the group consisting of Fe, Co, and Cr, and the balance being titanium, and satisfying the following equations:

0.85 wt. %≦X wt. %≦3.15 wt. %, 7 wt. %≦Y wt. %≦13 wt. %,

X wt. %=Fe wt. %+Co wt. %+0.9 Cr wt. %

Y wt. %=2×Fe wt. %+2×Co wt. %+1.8×Cr wt. %+1.5×V wt. %+Mo wt. %, and superplastic forming the heat treated alloy.

24. The method of claim 23, wherein the Al content is 4 to 5 wt.%.

25. The method of claim 23, wherein the V content is 2.5 to 3.7 wt. %.

26. The method of claim 23, wherein the Mo content is 1.5 to 2.37 wt. %.

27. The method of claim 23, wherein the Al content is 4 to 5 wt. %, the V content is 2.5 to 3.7 wt. % and the Mo content is 1.5 to 2.37 wt. %.

28. The method of claim 23, wherein the X wt. % is specified as follows:

1.5 wt. %≦X≦2.5 wt. %.

29. The method of claim 23, wherein the Y wt. % is specified as follows:

9 wt. %≦Y≦11 wt. %.

30. The method of claim 23, wherein the X wt. % and Y wt. % are specified as follows:

1.5 wt. %≦X≦2.5 wt. %; and 9 wt. %≦Y≦11 wt. %.

31. The method of claim 23, wherein the group consists of Fe and Co.

32. The method of claim 23, wherein the group consists of Fe and Cr.

33. The method of claim 23, wherein the group consists of Fe.

34. The method of claim 23, wherein the O content is 0.01 to 0.15 wt. %.

35. The method of claim 27, wherein the X wt. % and Y wt. % are specified as follows:

1.5 wt. %≦X≦2.5 wt. %; and 9 wt. %≦Y≦11 wt. %.

36. The method of claim 31, wherein the Al content is 4 to 5 wt. %, the V content is 2.5 to 3.7 wt. %, and the Mo content is 1.5 to 2.37 wt. %.

37. The method of claim 32, wherein the Al content is 4 to 5 wt. %, the V content is 2.5 to 3.7 wt. %, and the Mo content is 1.5 to. 2.37 wt. %.

38. The method of claim 33, wherein the Fe content is 1 to 2.5 wt. %.

39. The method of claim 33, wherein the Al content is 4.0 to 5.0 wt. %, the V content is 2.5 to 3.7 wt. %, and the Mo content is 1.5 to 2.37 wt. %.

40. The method of claim 38, wherein the Fe content is 1.5 to 2.5 wt. %.

41. The method of claim 38, wherein the Al content is 4.0 to 5.0 wt. %, the V content is 2.5 to 3.7 wt. %, and the Mo content is 1.5 to 2.37 wt. %.

42. The method of claim 40, wherein the Al content is 4.0 to 5.0 wt. %, the V content is 2.5 to 3.7 wt. %, and the No content is 1.5 to 2.37 wt. %.

43. The method of claim 42, wherein the Y wt. % is specified as follows:

9 wt. %≦Y≦11 wt. %.

44. A method Of superplastic forming of a titanium base alloy for superplastic forming comprising the steps of:

heat treating a titanium base alloy to a temperature ranging from $\beta$-transus minus 250° C. to $\beta$-transus;

the titanium base alloy consisting essentially of about 3 to 5 wt. % Al, 2.1 to 3.7 wt. % V, 0.85 to 3.15 wt. % Mo, at least 0.01 wt. % O, at least one element selected from the group consisting of Fe, Ni, Co, and Cr, and the balance being titanium, and satisfying the following equations:

$$0.85 \text{ wt. } \% \leqq X \text{ wt. } \% \leqq 3.15 \text{ wt. } \%,$$

$$7 \text{ wt. } \% \leqq Y \text{ wt. } \% \leqq 13 \text{ wt. } \%,$$

$$X \text{ wt. } \% = Fe \text{ wt. } \% + Ni \text{ wt. } \% + Co \text{ wt. } \% + 0.9\ Cr \text{ wt. } \%$$

$$Y \text{ wt. } \% \leqq 2 \times Fe \text{ wt. } \% + 2 \times Ni \text{ wt. } \% + 2 \times Co \text{ wt. } \% \leqq 1.8 \times Cr \text{ wt. } \% + 1.5 \times V \text{ wt. } \% + Mo \text{ wt. } \%, \text{ and}$$

superplastic forming the heat treated alloy.

45. The method of claim 44, wherein the O content is 0.01 to 0.15 wt. %.

46. The method of claim 44, wherein the Al content is 3.42 to 5 wt. %.

47. The method of claim 44, wherein the O content is 0.01 to 0.15 wt. % and the Al content is 3.42 to 5 wt. %.

48. The method of claim 44, wherein the Mo content is 0.85 to 2.37 wt. %.

49. The method of claim 44, wherein the O content is 0.01 to 0.15 wt. % and the Mo content is 0.85 to 2.37 wt. %.

50. A method of making a titanium base alloy comprising the steps of:

heating a titanium base alloy to a temperature ranging from $\beta$-transus minus 250° C. to $\beta$-transus;

the titanium base alloy consisting essentially of about 3.42 to 5 wt. % Al, 2.1 to 3.7 wt. %; V, 0.85 to 2.37 wt. % Mo, at least 0.01 wt. % O, at least one element selected from the group consisting of Fe, Co, and Cr, and the balance being titanium, and satisfying the following equations:

$$0.85 \text{ wt. } \% \leqq X \text{ wt. } \% \leqq 3.15 \text{ wt. } \%,$$

$$7 \text{ wt. } \% \leqq Y \text{ wt. } \% \leqq 13 \text{ wt. } \%,$$

$$X \text{ wt. } \% = Fe \text{ wt. } \% + Co \text{ wt. } \% + 0.9\ Cr \text{ wt. } \%$$

$$Y \text{ wt. } \% = 2 \times Fe \text{ wt. } \% + 2 \times Co \text{ wt. } \% + 1.8 \times Cr \text{ wt. } \% + 1.5 \times V \text{ wt. } \% + Mo \text{ wt. } \%, \text{ and}$$

hot forging the heated alloy with a reduction ratio of at least 50%.

51. The method of claim 50, wherein said hot forging is iso-thermal forging.

52. The method of claim 50, wherein said hot forging is hot die forging.

53. The method of claim 50, wherein said hot forging is ordinary hot forging.

54. A method of making a titanium base alloy comprising the steps of:

heating a titanium base alloy to a temperature ranging from $\beta$-transus minus 250° C. to $\beta$-transus;

the titanium base alloy consisting essentially of about 3.42 to 5 wt. % Al, 2.1 to 3.7 wt. % V, 0.85 to 2.37 wt. % Mo, at least 0.01 wt. % O, at least one element selected from the group consisting of Fe, Co, and Cr, and the balance being titanium, and satisfying the following equations:

$$0.85 \text{ wt. } \% \leqq X \text{ wt. } \% \leqq 3.15 \text{ wt. } \%,$$

$$7 \text{ wt. } \% \leqq Y \text{ wt. } \% \leqq 13 \text{ wt. } \%,$$

$$X \text{ wt. } \% = Fe \text{ wt. } \% + Co \text{ wt. } \% + 0.9\ Cr \text{ wt. } \%$$

$$Y \text{ wt. } \% = 2 \times Fe \text{ wt. } \% + 2 \times Co \text{ wt. } \% + 1.8 \times Cr \text{ wt. } \% + 1.5 \times V \text{ wt. } \% + Mo \text{ wt. } \%, \text{ and}$$

hot extruding the heated alloy with a reduction ratio of at least 50%.

* * * * *

UNITED STATES PATENT AND TRADEMARK OFFICE

CERTIFICATE OF CORRECTION

PATENT NO. : 5,411,614

DATED : May 2, 1995

INVENTOR(S) : OGAWA et al

It is certified that error appears in the above-identified patent and that said Letters Patent is hereby corrected as shown below:

Column 5, line 38, after "with" insert --Al--.

Column 7, Table 1, line A10, under Column "Ni", delete "1.74" and insert --1.77--.

Column 17, line 47, (claim 22), delete "claim 20" and insert --claim 21--.

Signed and Sealed this

Ninth Day of December, 1997

*Attest:*

*Attesting Officer*

BRUCE LEHMAN

*Commissioner of Patents and Trademarks*